United States Patent [19]

Crane

[11] Patent Number: 4,843,717

[45] Date of Patent: Jul. 4, 1989

[54] HAIR CUTTING DEVICE WITH A VACUUM DISPOSAL

[76] Inventor: Larry A. Crane, 263 River Rd., Franklin, N.C. 28734

[21] Appl. No.: 250,852

[22] Filed: Sep. 28, 1988

[51] Int. Cl.[4] ..... B26B 19/44

[52] U.S. Cl. ..... 30/133; 30/41.6

[58] Field of Search ..... 30/133, 41.6, 132, 131, 30/124

[56] References Cited

U.S. PATENT DOCUMENTS

| | | | |
|---|---|---|---|
| 2,946,123 | 7/1960 | Bray | 30/133 X |
| 3,440,681 | 4/1969 | Hixson et al. | 30/133 X |
| 3,900,949 | 8/1975 | Anzalone | 30/133 |
| 3,975,821 | 8/1976 | Flicker | 30/133 X |
| 3,979,825 | 9/1976 | Baumann | 30/133 |
| 4,030,196 | 6/1977 | Koiwa et al. | 30/133 |
| 4,150,483 | 4/1979 | Kanazawa | 30/133 |
| 4,216,581 | 8/1980 | van Slooten | 30/133 |
| 4,590,675 | 5/1986 | Louw | 30/133 |
| 4,628,601 | 12/1986 | van Slooten | 30/133 |

*Primary Examiner*—Douglas D. Watts

*Attorney, Agent, or Firm*—Shefte, Pinckney & Sawyer

[57] ABSTRACT

A hair cutting device including a generally rectangular conduit with an open inlet end and an opposite end connected to a vacuum source, and electrically operated hair clippers are carried by a housing so that the cutting elements of the hair clipper extend into the rectangular conduit and into the flow path of the air passing therethrough. A slot is also formed in the conduit to permit auxiliary air to be drawn into the conduit in such a manner as to direct hair entrained in the air flow within the conduit to be directed generally toward the cutting elements. A baffle plate may be provided proximate the cutting elements and downstream of the cutting elements and the slot. Also, the slot may be adjusted, both in terms of size and location relative to the cutting elements.

11 Claims, 2 Drawing Sheets

FIG. 1
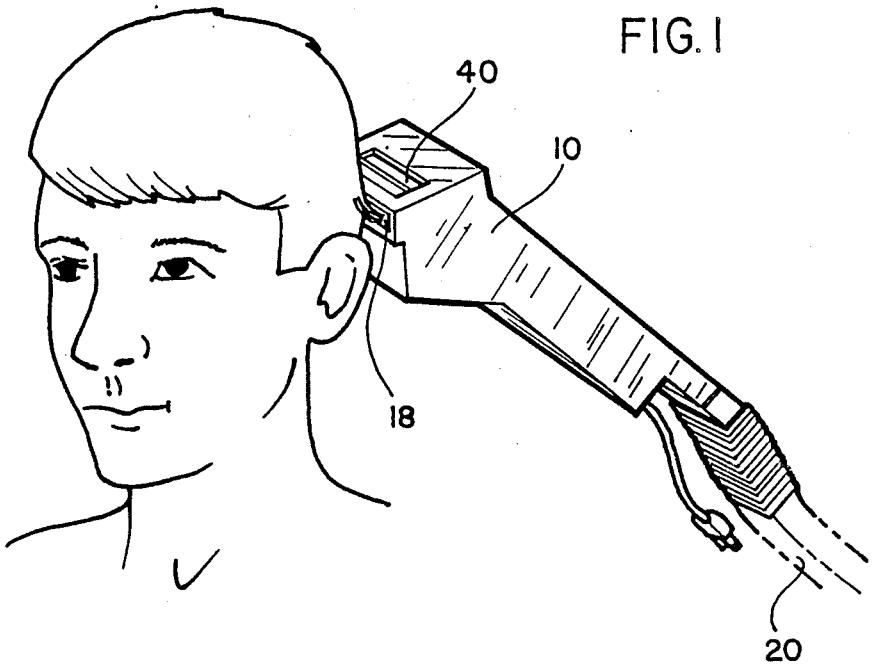
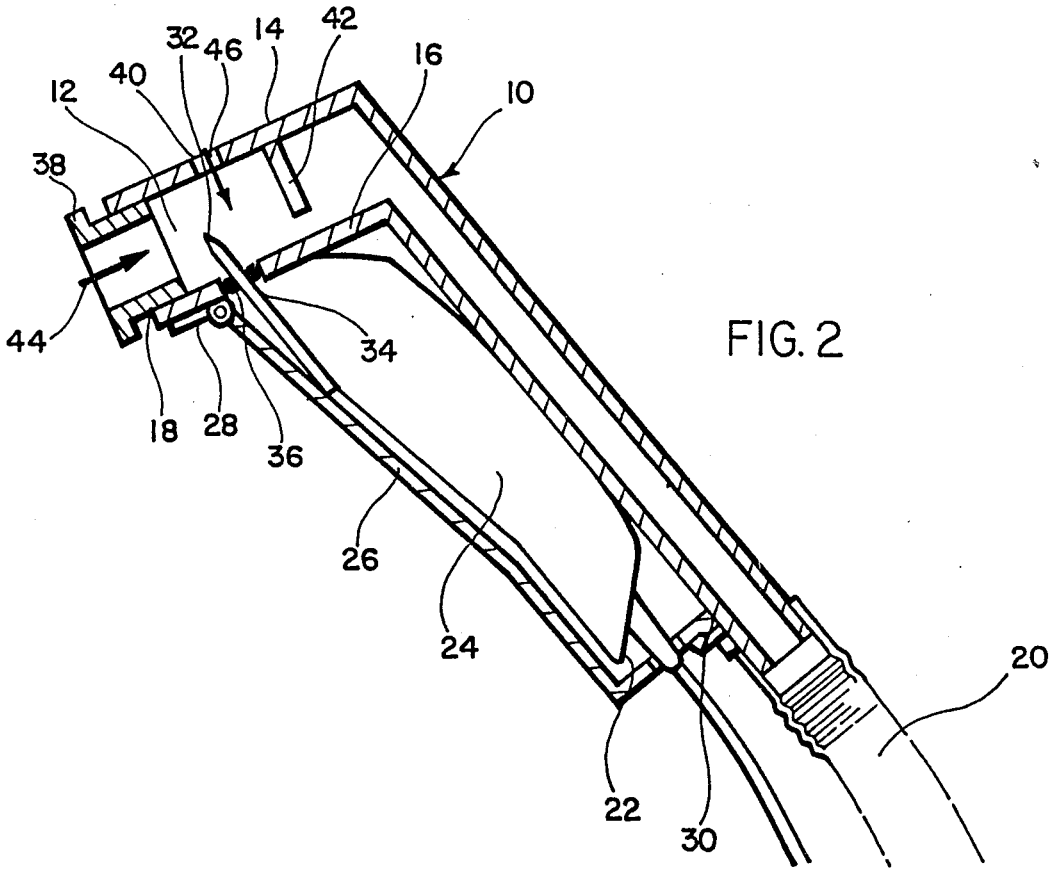
FIG. 2

HAIR CUTTING DEVICE WITH A VACUUM DISPOSAL

BACKGROUND OF THE INVENTION

The present invention relates generally to devices for cutting hair, and more particularly to devices of the type which employ a suction source to draw hair into a confined area where the hair is cut by cutting elements.

Traditionally, hair has been cut and trimmed using conventional cutting implements such as scissors and/or electrically operated clippers having blades that are motor-driven to provide a cutting motion. These traditional types of cutting implements are usually hand-held, and they therefore can be manipulated and moved in virtually any direction to compensate for variations in hair length, hair texture and the like. While these implements provide satisfactory results over a wide range of hair types, they usually require skilled handling by professionals, such as barbers and hair stylists who have been trained and who have acquired experience in dealing with the problems presented by this range of hair types. Because of the skills required to operate these tools, and the fact that the operator must visually observe the cutting operation itself so as to properly manipulate the implements during varying cutting operations (e.g. sideburns and longer back hair), it is not feasible for an individual to cut his or her own hair using these types of implements.

In an effort to provide a more controlled hair cutting operation that may be suitable for individual use, and professional use requiring reduced skills, it has been proposed heretofore to produce hair cutting devices that employ some type of generally enclosed conduit through which hair to be cut is drawn using a suction source, and cutting implements are disposed in the conduit and in the path of the hair drawn therein, whereby hair is cut and carried away with the air flow created by the suction source.

A typcal hair cutting device of the aforesaid type is disclosed in Baumann U.S. Pat. No. 3,979,825, in which conventional electrical hair clippers are positioned within a cylindrical housing having a source of suction attached at one end thereof to draw air, and hair, into the conduit through the other end. A specially formed deflector is placed in the conduit adjacent the cutting elements of the hair clipper for directing the air along a predetermined, relatively narrow flow path that is intended to ensure that the hair entrained in the air reaches the cutting elements of the hair clipper. The patent also discloses arrangements for selectively adjusting the position of the hair clipper with respect to the deflector to vary the path of the air and hair therebetween. While some measure of control of the air is obtained in this type of device, the air with the hair entrained therein is forced by the deflector to flow through a relatively narrow flow path defined by the deflector and the cutting elements to ensure that all of the hair is presented to the cutting elements, and it is believed that this narrow confined flow path significantly limits the application of the device in terms of its being universally usable with a wide range of varying hair textures, lengths and the like as would be required for a commercially feasible hair cutting device.

Other generally similar suction-type hair cutting devices are disclosed in U.S. Pat. Nos. 3,900,949, 4,030,196, 4,590,675 and 4,628,601, but they also have some of the same drawbacks as those described above, and in some cases, they suffer additional drawbacks such as complexity of construction and operation, and inadequate control of the presentation of hair to the cutting elements.

By contrast, the present invention provides a hair cutting device that is relatively simple and inexpensive to produce, and which provides a unique arrangement for properly directing a wide variety of hair types and hair lengths toward the cutting elements without requiring any significant skills for the user of the device.

SUMMARY OF THE INVENTION

Briefly summarized, the present invention provides an apparatus for cutting hair which includes a generally enclosed conduit through which air is passed, such conduit having one open end providing a primary air inlet, and having its other end connected to a suction source so that ambient air is drawn into the conduit through the air inlet and passed through at least a portion of the conduit along a predetermined flow path. Cutting elements are disposed within the conduit and in the flow path of the air for cutting hair that is drawn into the conduit through the air inlet, and an aperture arrangement is provided in the wall of the conduit means that permits a predetermined quantity of auxiliary air to also be drawn into the conduit through such aperture by the suction source, and the aperture is disposed to direct the auxiliary air generally toward the cutting elements and in a direction generally transverse to the flow path of the ambient air drawn into the conduit through the primary air inlet, whereby the auxiliary air will direct and engage hair that is entrained in the primary air flow and direct it toward the cutting elements.

In one embodiment of the present invention, the cutting elements extend through one wall of the conduit means, and the aperture is in the form of a slot located in a wall of the conduit that is opposite to the wall through which the cutting elements extend, thereby providing a simple and inexpensive housing construction that nevertheless provides significant control of hair that is drawn into the device. A baffle may also be provided within the conduit, and in the path of the hair flow adjacent the cutting elements and the slot in a symbiotic relationship therewith to assist in properly directing the hair against the cutting elements.

In another embodiment of the present invention, the slot is formed in such a manner that its position can be selectively varied, and/or the opening or width of the slot can be selectively adjusted, whereby a significant measure of control can be imposed on the auxiliary, hair directing air flow so that the device of the present invention will accommodate a wide range of hair types, lengths and textures.

BRIEF DESCRIPTION OF THE DRAWINGS

FIG. 1 is a general perspective view of the hair cutting apparatus of the present invention, shown as it might be used in cutting hair;

FIG. 2 is a side elevational view, partly in section, of the embodiment of the present invention illustrated in FIG. 1.

Figure 3:
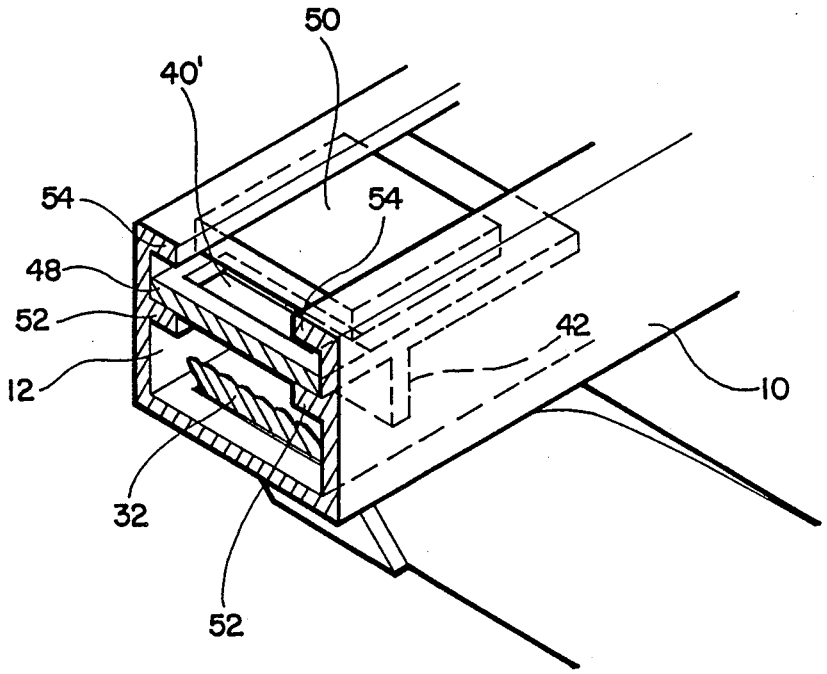
FIG. 3 is a detail view illustrating an alternate embodiment of the present invention in which the slot is adjustable in size and position.

position in which it would be hand-held for cutting one portion of hair, the hand which would normally hold the device being omitted in FIG. 1 for clarity of illustration. As best seen in FIG. 2, this hair cutting apparatus includes a housing 10 that provides a generally enclosed conduit 12 formed by walls arranged in a generally rectangular cross-section, with an upper wall 14 and a lower, opposite wall 16. The forward end of the conduit 16 is open to provide a primary air inlet 18, and the opposite end of the conduit 16 is connected to any convenient suction source, such as by utilizing a flexible conduit 20 of a conventional vacuum cleaner device (not shown), so that when the suction source is energized air will be drawn into the conduit 16 through the primary air inlet 18 and will flow through the air conduit 16 for withdrawal to the vacuum cleaner through the hose 20.

The housing 10 is also provided with a compartment 22 in which a conventional electric hair clipper 24 is carried, the compartment 22 being formed in part by a wall portion 26 pivotably mounted at one of its ends by a hinge connection 28, and having a selectively releasable conventional latch member 30 at its other end. Accordingly, to the extent that it may be necessary to replace or repair the hair clipper 24, the latch member 30 is released and the wall portion 26 is pivoted outwardly about the hinge 28 to permit removal and insertion of the hair clipper 24 in the compartment 22. The hair clipper 24 is carried in the compartment 22 so that the movable cutting elements 32 of the hair clipper 24 extend through an opening 34 in the lower housing wall 16, and a suitable sealing element 36, such as a highly resilient rubber seal, is provided for effectively sealing the opening 34 when the cutting elements 32 extend therethrough, while still permitting the cutting elements to be inserted in, and removed from, the opening 34 when the hair clipper 24 is removed from or placed in the compartment 22. Also, as shown in FIG. 2, the cutting elements extend through the lower wall 16 in a direction generally perpendicular thereto so that the cutting elements extend directly into the conduit 12 and directly into the flow path of the air as it passes substantially axially through the conduit 12 from the primary air inlet 18 to the suction hose 20.

In some applications of the device of the present invention, it may be desirable to adjust the length of the housing 10 between the primary air inlet 18 and the cutting elements 32. Accordingly, as seen in FIG. 2, an inlet extender element 38 may be slidably and telescopically received about the end of the housing at the primary air inlet 18, the sliding fit being sufficiently tight that the extender element 38 will not move with respect to the main portion of the housing 10 during normal use of the device when the end of the extender element is pressed against the head of the person whose hair is being cut, but can be moved when sufficient force is applied manually to the extender element 38 for adjustment purposes.

As best seen in FIG. 2, the upper wall 14 of the housing 10 is provided with a slot 40 that is located generally across from the cutting elements 32 and just forwardly thereof. This slot 40 has a lengthwise extent that correin a direction generally transverse to the flow path of the air through the conduit 12. The baffle 42 is disposed downstream of the slot 40 and downstream of the cutting elements 32, and the baffle is located proximate the cutting elements 32.

In operation, the flexible conduit 20 is connected to a convenient vacuum source, and primary air is drawn into the conduit 12 through the primary air inlet 18 as indicated by the direction arrow 44. When the hair cutting device is placed against a head of hair, the suction and inflow of air at the primary air inlet 18 will draw hair into the conduit 12 in a direction that is generally axial. The same vacuum will also cause a lesser quantity of ambient air to be drawn into the conduit 12 through the slot 40, and as indicated by the direction arrow 46 the slot 40 is disposed to direct this auxiliary air in a direction generally transverse to the flow path of the primary air, and in a direction generally toward the cutting elements 32. Because of the size of the air inlet 18, a relatively large quantity of hair can be drawn into the conduit 12, and since this hair is entrained in a relatively rapid flowing quantity of air, the individual strands of hair tend to flutter and fluctuate as they are pulled along the length of the conduit 12. However, when the ends of the strands of hair reach a position in the conduit 12 adjacent the slot 40, the incoming auxiliary air, with its direction of flow transverse to the flow of the primary air, will direct the ends of the strands of hair toward the cutting elements 32 and into engagement therewith for cutting. Moreover, when the strands of hair are particularly long, the ends of these strands of hair will abut the baffle 42 and be directed downwardly into the spacing between the cutting elements 32 and the bottom portion of the baffle 42, where the primary air is forced to flow. Thus, the auxiliary air from the slot 40 will reduce the extent of the fluctuations of the ends of the strands of hair when they reach the cutting elements 32, and the auxiliary air will actually direct and guide the ends of the hair into contact with the cutting elements 32. In some applications that auxiliary air flow cooperates with the effect of the baffle 42 to direct some strands of hair against the cutting elements 32. After the strands of hair have been cut by the cutting elements 32, the cut portions are quickly drawn away from the cutting elements 32 and carried through the flexible conduit 20 for collection and disposal in any convenient manner. It will be appreciated that the construction and arrangement of the various elements of the present invention provide significant advantages. The inlet 18 is of a size that permits a relatively large quantity of hair to be drawn into the conduit 12, and since there is no obstruction between the air inlet 18 and the cutting elements 32, all of the entrained hair can be brought to the cutting elements for cutting. Moreover, the relatively large area of the conduit 12 upstream of the cutting elements 32 would normally create problems resulting from the aforesaid fluctuations of the individual hair strands in the airstream, but this problem is overcome by the auxiliary air entering the conduit 12 through the slot 40 which directs the hair strands toward and into contact with the cutting elements 32. Where the hair strands are unusually long, and the auxiliary airstream is less effective in directing the ends of the hair strands into contact with the cutting elements 32, the baffle 42 serves to cooperate with the auxiliary air in directing even these strands into contact with the cutting elements 32. It is also to be noted that the ends of the hair strands which have been cut do not interfere with any motors or other moving parts after they have been cut, as is the case in many of the above-discussed prior art devices. More specifically, whereas the entire hair clipper is located directly in the air flow in U.S. Pat. No. 3,979,825, so that cut hair particles can foul the operation of the electric motor and other moving parts in the hair clipper, the hair clipper 24 of the present invention is located outside of the conduit 12 so that only the cutting elements 32 extend into the conduit 12, and once the ends of the hair have been cut, they are quickly carried away through a conduit in which there are no moving parts of any kind. Finally, although significant control of the hair is obtained by the present invention, it will be appreciated that the overall construction of the device of the present invention is quite simple, without any moving parts other than the hair clipper itself, and the device of the present invention is therefore inexpensive to produce and is virtually maintenance free, except for the routine maintenance for the hair clipper that is inherent in all devices of this type.

Even greater control of the hair can be obtained in a second embodiment of the present invention which is illustrated in FIG. 3, where only the front or inlet end of the housing 10 is shown because the remainder of the device is identical to that described above in connection with the embodiment illustrated in FIGS. 1 and 2. In this embodiment, the upper wall 14 of the housing 10 includes a pair of overlapping plates 48 and 50 mounted for slidable movement with respect to the housing 10 within the confines of a channel formed between parallel shoulders 52 and 54. The plate 48 rests on the lower shoulder 52 in slidable relationship therewith, and it includes a rectangular slot 40' which is larger than the slot 40 of the embodiment shown in FIGS. 1 and 2. The upper plate 50 is contained between the lower plate 48 and the upper shoulder 54, and it is arranged for sliding movement along the top surface of the lower plate 48 with the leading edge of the upper plate 50 being disposed generally at the slot 40'. In looking at FIG. 3, it will be apparent that the effective size of the slot 40', in terms of how much air is admitted to the conduit 12 therethrough, can be varied by moving the upper plate 50 relative to the lower plate 48 to reduce or enlarge the exposed opening in the lower plate 48. Moreover, apart from adjusting the effective size of the slot 40' itself, it is also possible to adjust the position of the slot 40' with respect to the cutting elements 32 by moving both the upper and lower plates 48, 50 together as a unit. Although there are many ways of controlling the movement of the plates 48, 50, the simplest method contemplated by the present invention is to select a thickness for the plates 48, 50 which will fit between the shoulders 52, 54 with a tight fit so that the position of the plates 48, 50 will not normally change during use of the hair cutting device of the present invention, but nevertheless permitting relative movement of either or both of the plates 48, 50 when sufficient manual force is applied thereto. If desired or necessary, any convenient form of stops can be applied to limit the overall movement of one or both of the plates 48, 50.

While the movable plates 48, 50 in the embodiment shown in FIG. 3 add slightly to the cost and complexity of the device, the embodiment illustrated in FIG. 3 otherwise offers all of the advantages described above in connection with the embodiment shown in FIGS. 1 and 2, and it provides significant additional advantages. The capacity to selectively vary the size and the location of the slot 40' provides the hair cutter device of the present invention with unusual versatility that lends itself to effectively cutting virtually all types of hair, regardless of length, texture, and style. This versatility of the hair cutting device of the present invention can provide significant commercial advantages in that the devices can be sold to a universal customer market, and the adjustability of the device offered by the movable plates 48, 50 will provide the ultimate customer with confidence that he or she can adjust the plates 48, 50 in a manner that will be tailored to the particular hair characteristics of the user.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. Apparatus for cutting hair, such apparatus comprising wall means defining a generally enclosed conduit for passing air therethrough, said conduit having one open end providing a primary air inlet, suction means connected to said conduit to draw ambient air into said conduit through said air inlet and to cause such air to pass through at least a portion of said conduit along a predetermined flow path, cutting means disposed within said conduit in said flow path for cutting hair drawn into said conduit through said air inlet by said suction means, and aperture means provided in said wall means for permitting a predetermined quantity of directing air to be drawn into said conduit by said suction means, said aperture means being disposed to direct said directing air generally toward said cutting means and in a direction generally transverse to said flow path of said ambient air drawn into said conduit through said air inlet so that said directing air will engage said hair and direct it toward said cutting means.

2. Apparatus for cutting hair as defined in claim 1 and further characterized in that said aperture means is a slot formed in said wall means at a position generally across said flow path from said cutting means.

3. Apparatus for cutting hair as defined in claim 2 and further characterized in that said slot has a lengthwise extent of substantially the same dimensions as the lengthwise extent of said cutting means.

4. Apparatus for cutting hair as defined in claim 2 and further characterized in that said aperture means includes movable means for selectively varying the position of said slot with respect to said cutting means.

5. Apparatus for cutting hair as defined in claim 2 and further characterized in that said aperture means includes adjusting means for selectively varying the size of said slot.

6. Apparatus for cutting hair as defined in claim 5 and further characterized in that said aperture means includes movable means for selectively varying the position of said slot with respect to said cutting means.

7. Apparatus for cutting hair as defined in claim 6 and further characterized in that said movable means includes a first element formed with said slot therein, said first element being a slidable part of said wall means, and in that said adjusting means includes a second element forming part of said wall means and being slidable with respect to said first element to vary the effective size of said slot.

8. Apparatus for cutting hair as defined in claim 7 and further characterized in that baffle means is mounted on said first element for slidable movement therewith, said baffle means extending from said first element into said flow path of said air adjacent said cutting means for assisting in properly directing said hair toward said cutting means.

9. Apparatus for cutting hair as defined in claim 1 and further characterized in that baffle means extend into said flow path of air at a location adjacent said cutting means and adjacent said aperture means for assisting in properly directing said hair toward said cutting means.

10. Apparatus for cutting hair, said apparatus comprising:

(a) generally rectangular conduit means having an open end defining an air inlet;

(b) suction means attached to said conduit means for creating a negative pressure in said conduit means to cause ambient air to be drawn into said conduit through said air inlet and to move through said conduit means along a flow path extending substantially axially thereof;

(c) electrically operated hair clippers carried in said apparatus with cutting elements extending through a first wall of said rectangular conduit and into said flow path of said air;

(d) aperture means formed in a second wall of said rectangular conduit opposite to said first wall, said aperture means including a slot having a lengthwise extent substantially equal to the corresponding extent of said cutting elements of said hair clippers, and said slot being disposed in said second wall at a predetermined position with respect to said cutting elements such that directing air will be drawn into said conduit through said slot by said suction means in a direction that is transverse to said flow path of air through said conduit and that is generally toward said cutting elements; and (e) baffle means extending from said second wall into said conduit in a direction generally transverse to said flow path of said air, said baffle being disposed downstream of said slot and proximate said cutting elements, whereby a relatatively large quantity of air is drawn into said conduit through said air inlet for drawing hair into said conduit, and whereby a relatively small quantity of air is drawn into said conduit through said aperture means toward said baffle and said cutting elements for directing said hair into engagement with said cutting elements.

11. Apparatus for cutting hair as defined in claim 10 and further characterized in that said slot is formed by a pair of overlapping plates mounted for slidable movement with respect to one another and to said conduit, one of said plates having an opening formed therein and the other plate being arranged for slidable movement to cover varying portions of said opening, said plates being movable together to adjust the location of said slot with respect to said cutting elements, and said second plate being movable with respect to said first plate for selectively varying the size of said slot to thereby vary the quantity of air drawn in through said slot.

* * * * *